United States Patent [19]

Sato

[11] 4,435,069

[45] Mar. 6, 1984

[54] FIXING APPARATUS FOR ELECTROPHOTOGRAPHY

[75] Inventor: Masamichi Sato, Saitama, Japan

[73] Assignee: Fuji Photo Film Co., Ltd., Asaka, Japan

[21] Appl. No.: 414,723

[22] Filed: Sep. 3, 1982

[30] Foreign Application Priority Data

Sep. 4, 1981 [JP] Japan ..... 56-138378

[51] Int. Cl.[3] ..... G03G 15/00

[52] U.S. Cl. ..... 355/3 FU; 355/3 DR; 355/14 FU; 219/216; 219/244; 219/354; 219/10.55 R

[58] Field of Search ..... 355/3 FU, 14 FU, 3 DR; 219/216, 243, 244, 354, 10.55 R; 250/318, 319, 337; 430/4, 136

[56] References Cited

U.S. PATENT DOCUMENTS

| | | | |
|---|---|---|---|
| 2,807,703 | 9/1957 | Roshon, Jr. | 355/3 FU X |
| 2,807,704 | 9/1957 | Allen et al. | 355/3 FU X |
| 3,529,129 | 9/1970 | Rees | 219/216 |
| 3,655,280 | 4/1972 | Zoppoth | 355/3 FU |
| 3,684,362 | 8/1972 | Weigl | 355/3 DR |
| 4,270,449 | 6/1981 | Ito et al. | 355/3 FU X |
| 4,399,341 | 8/1983 | Yasuoka | 219/10.55 R |

*Primary Examiner*—A. C. Prescott
*Attorney, Agent, or Firm*—Sughrue, Mion, Zinn, MacPeak, and Seas

[57] ABSTRACT

A fixing apparatus for electrophotography includes a fixing drum having an infrared radiation heat source in the interior thereof and a backing roller which cooperates with the fixing drum to transport a recording sheet. The fixing drum is made of a transparent material that is permeable to infrared radiation and has an outer coating of a material that absorbs a part of the infrared radiation.

8 Claims, 2 Drawing Figures

FIXING APPARATUS FOR ELECTROPHOTOGRAPHY

BACKGROUND OF THE INVENTION

The present invention relates to a fixing apparatus for electrophotography, and more particularly to a thermal fixing apparatus combining the noncontact fusion method using an infrared radiation source with the contact fusion method using a heated roller.

In electrophotography, a toner image is usually thermally fixed to the paper to become permanent, and the conventional electrophotographic copier achieves this object by using a radiation heat source, a heated roller, a heated plate or an oven. In the first method, an infrared lamp is used as the radiation heat source and the necessary heat can be applied throughout the fixing step, but if the image density is low, the toner does not absorb the necessary heat to provide a satisfactorily fixed image. This defect can be eliminated by using a powerful heat source, but then, the fire hazard of and the size of the fixing apparatus are increased. In the second and third methods, the toner image is placed in direct contact with a heated roller or plate, and the heating efficiency is high enough to achieve comparatively good fixing even if the image density is low. But either method requires 4 to 5 minutes to warm the roller or plate to the desired temperature, and moreover, the roller or plate must be heated throughout the operation of the copier to maintain the fixing temperature nearly constant, resulting in high power consumption. The use of an oven also requires a fairly long warm-up period and sustained heating that leads to high power consumption.

SUMMARY OF THE INVENTION

Therefore, an object of the present invention is to provide a fixing apparatus for use in electrophotography which has high heat efficiency and assures satisfactory fixing of the toner image without requiring sustained heating and creating a fire hazard.

DETAILED DESCRIPTION OF THE PREFERRED EMBODIMENTS

An apparatus for fixing a developed or transferred image using a drum made of material which is permeable to infrared radiation from a heat source incorporated in the center of the drum is disclosed in Japanese Patent Application (OPI) No. 98639/74. The fixing apparatus of the present invention differs from this apparatus in that the drum has an outer coating made of a material that absorbs part of the infrared radiation and allows another part to be transmitted (transmittance: 30–70%). A recording sheet carrying the toner image is passed between the so coated drum and a backing roller to fix the image on the sheet by fusion contact. According to the present invention, part of the radiation from the infrared heat source is absorbed by the drum surface and is used to heat the same in a very short period, whereas the remaining part of the radiation passes through the drum to achieve preliminary heating of the toner image on the recording sheet being transported between the drum and the backing roller.

Figure 1:
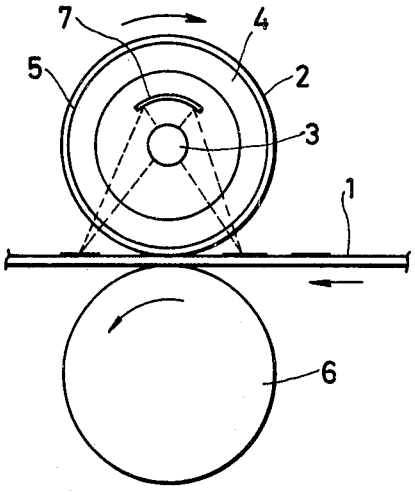
FIG. 1 is a cross sectional view of the fixing apparatus according to one embodiment of the present invention.

FIG. 1 is a cross section of the fixing apparatus according to one embodiment of the present invention. In FIG. 1, reference numeral 1 indicates a recording sheet such as a developed photosensitive paper or paper to which the toner image has been transferred from the photoreceptor; the numeral 2 indicates a fixing drum having an outside diameter of 30 mm; reference numeral 6 indicates a backing roller that rotates with the fixing drum while applying a light pressure to the recording sheet being transported between the drum and the roller. The backing roller is made of a pure metal or a metal coated with polyfluoroethylene, silicone, rubber or other plastics.

When the recording sheet 1 is transported between the fixing drum and the backing roller with the surface carrying the toner images in contact with the fixing drum, an infrared lamp or other infrared radiation heat source 3 within the fixing drum is switched on and emits infrared radiation which passes through transparent, light-tight heat-resistant glass 4 having a thickness of 5 mm so as to heat the light-absorbing layer 5 on the surface of the fixing drum. The light-absorbing layer 5 has a thickness of 0.1 to 1 mm and is made of a baked low-boiling melting point glass (400° C.) pigmented with a black colorant such as carbon or iron oxide. Alternatively, the light-absorbing layer may be made of a thin about (500 Å) but strong vapor-deposited black film made of chrome-nickel, tantalum, molybdenum or oxides or alloys thereof. The surface temperature of the fixing drum is increased by the absorbed heat very quickly. On the other hand, that part of the infrared radiation which has been transmitted through the surface of the fixing drum is used to heat the toner particles on the recording sheet very quickly.

The fixing apparatus of the present invention may further include means for assuring complete fixing of the toner image by applying heat thereto even after it has passed between the fixing drum and the backing roller. An example of such means is a reflector mirror 7 made of a high-reflectance material such as Au, Ag, Pt or Al that reflects the infrared radiation from the heat source 3. The heat source 3 is typically composed of a tubular (dia. 7–8 mm) tungsten filament infrared lamp. The heat source 3 is designed so that it emits infrared radiation only while the recording sheet is transported and passed between the fixing drum and the backing roller, but if the recording sheet is transported continuously, the temperature of the drum surface becomes quite elevated. Therefore, to prevent an excessive increase in the surface temperature, a thermostat (not shown) may be incorporated in the fixing apparatus of the present invention as in conventional equipment. The fixing apparatus may also include a silicon oil impregnated pad (not shown) or other means for cleaning the drum surface.

Figure 2:
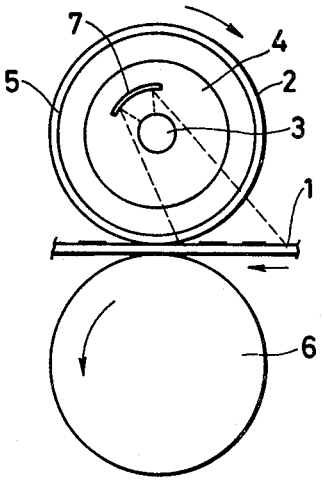
FIG. 2 is a cross section of another embodiment of the fixing apparatus in which the reflector mirror is positioned differently than in FIG. 1.

FIG. 2 illustrates another embodiment of the fixing apparatus wherein the reflector mirror 2 is positioned differently than in FIG. 1 to effect more effective preliminary heating of the recording sheet 1.

As will be clear from the foregoing description, the fixing apparatus of the present invention combines the high fixing speed and heat efficiency of the contact fusing method with the advantageously strong heating of the infrared heating; because of this arrangement, the apparatus obviates the need of sustained heating and enables satisfactory fixing of the toner image with reduced power consumption. In addition, the apparatus is free from the fire hazard of the conventional noncontact fusing method which uses infrared radiation as the sole heat source. The apparatus is small, light-weight, needs no warm-up and consumes less power due to the absence of the need of sustained heating.

What is claimed is:

1. A fixing apparatus for use in electrophotography comprising; a fixing drum including an infrared radiation heat source in the interior thereof, said fixing drum being made of a transparent material permeable to infrared radiation and having an outer layer of a material which absorbs part of the infrared radiation.

2. An apparatus as claimed in claim 1, said outer layer having a transmittance of 30 to 70%.

3. An apparatus as claimed in claim 1, said outer layer comprising a vapor-deposited black film.

4. An apparatus as claimed in claim 3, said film having a thickness of approximately 500 Å.

5. An apparatus as claimed in claim 1, said outer layer comprising pigmented light absorbing glass.

6. An apparatus as claimed in claim 1, further comprising a backing roller cooperating with said fixing drum to transport a recording sheet, said backing roller imparting a light pressure to said sheet.

7. An apparatus as claimed in claim 1, further including reflector means proximate said heat source for reflecting infrared radiation onto a recording sheet during contact of said sheet with said drum.

8. An apparatus as claimed in claim 1, further including reflector means proximate said heat source for reflecting infrared radiation onto a recording sheet to preheat toner images on said sheet before they contact the surface of said drum.

* * * * *